US007784339B2

(12) United States Patent
Cook et al.

(10) Patent No.: US 7,784,339 B2
(45) Date of Patent: Aug. 31, 2010

(54) PERFORATION LOGGING TOOL AND METHOD

(75) Inventors: John Mervyn Cook, Cambridge (GB); Ashley Bernard Johnson, Milton (GB)

(73) Assignee: Schlumberger Technology Corporation, Cambridge, MA (US)

( * ) Notice: Subject to any disclaimer, the term of this patent is extended or adjusted under 35 U.S.C. 154(b) by 201 days.

(21) Appl. No.: 11/667,230

(22) PCT Filed: Nov. 16, 2005

(86) PCT No.: PCT/GB2005/004416

§ 371 (c)(1),
(2), (4) Date: Nov. 26, 2007

(87) PCT Pub. No.: WO2006/054074

PCT Pub. Date: May 26, 2006

(65) Prior Publication Data

US 2008/0307877 A1 Dec. 18, 2008

(30) Foreign Application Priority Data

Nov. 17, 2004 (GB) ..... 0425308.4

(51) Int. Cl.
*E21B 49/00* (2006.01)

(52) U.S. Cl. ..... 73/152.57; 73/152.29

(58) Field of Classification Search ..... 73/152.18, 73/152.29–152.33, 152.57
See application file for complete search history.

(56) References Cited

U.S. PATENT DOCUMENTS 3,561,256 A 2/1971 Bustin et al.
4,435,978 A * 3/1984 Glatz ..... 73/152.31
4,525,815 A 6/1985 Watson
4,737,636 A 4/1988 Smith, Jr.
5,353,873 A * 10/1994 Cooke, Jr. ..... 166/64
5,551,287 A * 9/1996 Maute et al. ..... 73/152.02
5,816,343 A 10/1998 Markel et al.
6,513,591 B1 2/2003 Heijnen
6,711,947 B2 * 3/2004 Maute ..... 73/152.29
6,772,836 B2 * 8/2004 Schetky et al. ..... 166/277
6,779,407 B2 * 8/2004 Maute ..... 73/861.12
6,799,637 B2 * 10/2004 Schetky et al. ..... 166/384
6,877,553 B2 * 4/2005 Cameron ..... 166/207
6,971,271 B2 * 12/2005 Maute ..... 73/861.12
7,048,063 B2 * 5/2006 Cameron ..... 166/381
7,156,180 B2 * 1/2007 Schetky et al. ..... 166/380
7,178,418 B2 * 2/2007 Richter et al. ..... 73/866.5
7,185,709 B2 * 3/2007 Schetky et al. ..... 166/380

(Continued)

FOREIGN PATENT DOCUMENTS

GB 2 360 584 A 9/2001

(Continued)

*Primary Examiner*—John Fitzgerald
(74) *Attorney, Agent, or Firm*—James McAleenan; Brigid Laffey; Vincent Loccisano

(57) ABSTRACT

The present invention provides an apparatus an methods for detecting the behavior of perforations in a wellbore casing, the apparatus including a sensor array movable within the internal diameter of the casing, the sensor array having one or more sensors located proximate the internal surface of the casing with the sensors being located or oriented such that properties of flow from a proximate perforation can be distinguished from properties of a main flow through the wellbore.

12 Claims, 3 Drawing Sheets

U.S. PATENT DOCUMENTS

| | | | | |
|---|---|---|---|---|
| 7,398,831 | B2 * | 7/2008 | Schetky et al. | 166/380 |
| 7,509,852 | B2 * | 3/2009 | Maute | 73/152.29 |
| 7,574,907 | B2 * | 8/2009 | Maute | 73/152.29 |
| 2002/0046840 | A1 * | 4/2002 | Schetky et al. | 166/277 |
| 2002/0189337 | A1 * | 12/2002 | Maute | 73/152.19 |
| 2003/0079885 | A1 * | 5/2003 | Schetky et al. | 166/380 |
| 2003/0079886 | A1 * | 5/2003 | Schetky et al. | 166/382 |
| 2004/0040707 | A1 | 3/2004 | Dusterhoft et al. | |
| 2004/0083804 | A1 * | 5/2004 | Maute | 73/152.29 |
| 2004/0140090 | A1 | 7/2004 | Mason et al. | |
| 2005/0126316 | A1 * | 6/2005 | Richter et al. | 73/866.5 |

FOREIGN PATENT DOCUMENTS

| | | |
|---|---|---|
| SU | 909141 | 2/1982 |
| WO | WO 02/06593 A1 | 1/2002 |
| WO | WO 03/087536 A1 | 10/2003 |

* cited by examiner

PERFORATION LOGGING TOOL AND METHOD

CROSS-REFERENCE TO RELATED APPLICATIONS

This application claims the benefits of priority from:

i) Application Number 0425308.4, entitled "PERFORATING LOGGING TOOL," filed in the United Kingdom on Nov. 17, 2004; and ii) Application Number PCT/GB2005/004416, entitled "PERFORATION LOGGING TOOL AND METHOD," filed under the PCT on Nov. 16, 2005;

All of which are commonly assigned to assignee of the present invention and hereby incorporated by reference in their entirety.

The subject matter of the present invention relates to perforating operations. More specifically, the present invention relates to optimizing the performance of perforated completions.

BACKGROUND OF THE INVENTION

After drilling a wellbore into a hydrocarbon-bearing formation, the well is completed in preparation for production. To complete a well, a casing (liner), generally steel, is inserted into the wellbore. Once the casing is inserted into the wellbore, it is then cemented in place, by pumping cement into the gap between the casing and the borehole (annulus). The reasons for doing this are many, but essentially, the casing helps ensure the integrity of the wellbore, i.e., so that it does not collapse. Another reason for the wellbore casing is to isolate different geologic zones, e.g., an oil-bearing zone from an undesirable water-bearing zone. By placing casing in the wellbore and cementing the casing to the wellbore, then selectively placing holes in the casing, one can effectively isolate certain portions of the subsurface, for instance to avoid the co-production of water along with oil.

The process of selectively placing holes in the casing and cement so that oil and gas can flow from the formation into the wellbore and eventually to the surface is generally known as "perforating." One common way to do this is to lower a perforating gun into the wellbore using a wireline or slickline cable to the desired depth, then detonate a shaped charge mounted on the main body of the gun. The shaped charge creates a hole in the adjacent wellbore casing and the formation behind the casing. This hole is known as a "perforation". U.S. Pat. No. 5,816,343, assigned to Schlumberger Technology Corporation, incorporated by reference in its entirety, discusses prior art perforating systems.

In order to optimize the performance of perforated completions, it is necessary to know the details of the completion behaviour. For example, it is beneficial to know which perforations are flowing and which are not due to conditions such as formation debris blockage or tunnel collapse. Additionally, it is beneficial to know what fluids are flowing from the individual perforations and which tunnels are producing sand as well as hydrocarbons. If the behavioural details of the individual perforations are known, then treatments for detrimental conditions can be appropriately applied.

Related oilfield technology exists in a number of areas. For example, for open hole sections of the well, images are frequently acquired using tools such as the Ultrasonic Borehole Imager (i.e., acoustic pulses), the Formation Microscanner (i.e., electrical resistivity) or the GeoVision resistivity tool. However, these devices are not applicable to cased hole environments.

In cased holes, Kinley calipers or similar tools are used to form maps of damage or holes in casing by using mechanical feelers as the sensing elements. Downhole video cameras can also be used to view perforations in cased holes, but the well must be shut-in (or very nearly shut-in) and filled with filtered fluid for the cameras to be effective. Temperature logs and production logging tools can be used in cased holes but have no azimuthal sensitivity and insufficient depth resolution to detect problems with individual perforations.

There exists, therefore, a need to see the behaviour of individual perforations in a cased hole.

SUMMARY OF THE INVENTION

An embodiment of the present invention provides an apparatus for detecting the behavior of perforations in a wellbore casing. A sensor array is provided that is movable within the internal diameter of the wellbore casing. The sensor array is comprised of one or more sensors located proximate the internal surface of the casing and adapted to measure characterize flow properties in an azimuthal or radial direction relative to the wellbore axis.

The sensors can be mounted directly on a main body of the apparatus. They are however preferably mounted such that the flow through perforation into the wellbore is not impeded. More preferably the sensor are mounted on a mesh- or cage-like structure having an outer diameter close to the inner diameter of the cased wellbore. Alternatively the sensors may be mounted on arms extending from the main body of the tool in a caliper-like fashion.

Both variants place individual sensors in close proximity of perforations in the wellbore casing. If the sensors used for the purpose of the present invention have a directional sensitivity it is oriented azimuthally in radial direction. Otherwise the preferred sensors used in the present invention are local probes.

In a variant the invention may include flow diverting surfaces which divert flow with an azimuthal direction into the axial direction as defined by the orientation of the main axis of the wellbore. The diverting surface may additionally at least partially or temporally isolate the flow entering through proximate perforations from the main flow through the wellbore. In this variant the sensors are placed in close proximity of the diverting surface but may have a orientation in axial direction.

Preferred sensors of this invention include sensors which are capable of analyzing the flow characteristics such as flow volume, velocity and composition.

Another embodiment of the present invention provides a method of detecting the behaviour of perforations in a wellbore casing. The method comprises the steps of: moving a sensor array, having one or more sensors located proximate the internal surface of the casing, within the internal diameter of the casing; receiving location based data from the one or more sensors; and mapping the location based data.

These and other aspects of the invention will be apparent from the following detailed description of non-limitative examples and drawings.

DETAILED DESCRIPTION

The present invention provides an apparatus that provides a measurement with high spatial resolution to see the behavior of individual well perforations. The present invention utilizes an array of small sensors, to provide azimuthal coverage, that is moved up the wellbore to give axial coverage as well. Given the geometry of the array and its velocity along the well, the array of time-varying signals is converted from the sensor array into a map of the perforation properties.

Figure 1:
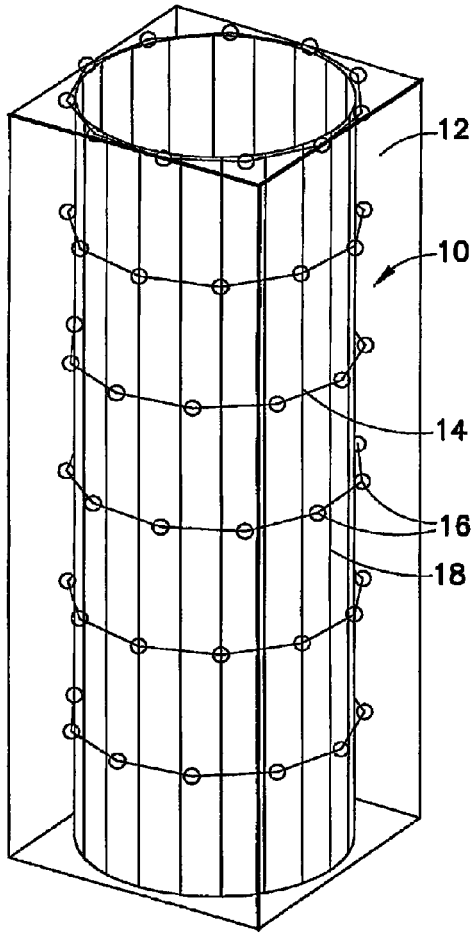
FIG. 1 provides a perspective view of a possible geometry of an embodiment of the sensor array of the present invention.

FIG. 1 illustrates a possible geometry for an embodiment of the present invention. The sensor array, indicated generally as 10, is shown within the internal diameter of a casing 12 and comprises a plurality of sensor rings 14 having multiple sensors 16 located thereon. In the embodiment shown, there are twelve (12) sensors 16 located on each of the six (6) sensor rings 14. Each sensor ring 14 is rotated by 10 degrees from the sensor ring 14 below resulting in each of thirty-six (36) azimuths of the cased hole being doubly sampled to give redundancy of measurements in case of failure of a sensor 16.

It should be recognized that depending upon the desired resolution, the sensor array 10 may be provided with any number of sensors 16, any number of sensor rings 14, and any number of possible orientations of the sensors 16. All such variations remain within the scope of the present invention.

The diameter of the sensor array 10 is preferably close in dimension to the internal diameter of the casing 12. Preferably, the sensors 16 should be located within a few millimeters of the internal diameter. In order to get the sensors in close proximity to the internal diameter of the casing 12, the network 18 on which the sensor array 10 is mounted is preferably flexible and able to conform to the internal diameter of the casing 12. The network 18 can, for example, be a wire mesh screen, or an expandable/collapsible screen. Alternatively, the sensor array 10 can be mounted on a non-expanding centralized mandrel. Although mounting the array 10 on a centralized mandrel would provide a much lower spatial resolution, the array 10 would provide a robust option.

Because the sensors 16 are placed in close proximity to the internal diameter of the casing 12, in some instances it may be necessary to protect the sensors 16 from damage resulting from perforation splash, scaling, or corrosion, for example. In one embodiment of the present invention, such protection is provided by placing guard rings around each sensor 16.

Preferably, the sensors 16 utilized in the sensor array 10 of the present invention are small and fast-acting. It will be recognized that a variety of sensors 16 can be utilized. One exemplary type sensor 16 is a hot film flow sensor. In this type of sensor, a small electrical current is used to heat a temperature sensitive resistive element. Fluid flow past the element cools it down, changing its electrical characteristics. This type of sensor would help in assessing which perforations are flowing in a well to allow for targeted remedial action.

Another exemplary type sensor 16 for use in the present invention is a temperature sensor such as miniature thermocouples, thermistors, or platinum resistance thermometers. These temperature sensors can be used, for example, in conjunction with injection tests to see where fluid is being accepted and withdrawn or to identify the source of a reservoir fluid.

Another exemplary type sensor 16 for use in the present invention is a fluid conductivity or dielectric constant sensor. These type sensors can be used to monitor the current passing between wetted electrodes, or the capacitance between them. The acquired data would assist in deciding which layers in a formation were prone to producing water rather than hydrocarbons.

Further exemplary type sensors 16 include, but are not limited to, fluid viscosity and/or density sensors using a Micro-Electro-Mechanical Systems (MEMS) device; chemical sensors for detecting hydrogen sulphide; and piezoelectric or similar impact detectors to detect the impact of sand grains in a sand-producing well.

All of the above exemplary type sensors 16 can be produced with a very small size. Accordingly, in an embodiment of the present invention, the sensors 16 are integrated on a single chip so that the sensors 16 can be removed and replaced in the sensor array 10 without difficulty.

The sensors 16 are primarily used to detect changes in the parameters as they pass a perforation opening in the casing 12. As such, response time and localization is more important than accuracy. Thus, it is not necessary that the sensors 16 provide accurate values of the flow, temperature, etc. However, in embodiments where such accurate measurements are required, appropriate sensors 16 can be placed within the sensor array 10.

To illustrate an embodiment of the present invention in use, consider the sensor array 10 of FIG. 1 in which the sensors 16 are hot film fluid velocity probes sensitive to changes in velocity. As the sensor array 10 is moved along the casing 12 of the well, each sensor 16 will be subject to the overall fluid flow along the well, which will be relatively constant. Whenever a sensor 16 passes a flowing perforation, it will be cooled slightly by the flow and will register a semi-quantitative signal at that location. After passing the flowing perforation, the sensor 16 will return to its heated state. In this manner, provided each sensor 16 is monitored individually, a map of the locations of the flowing perforations can be built.

Figure 2:
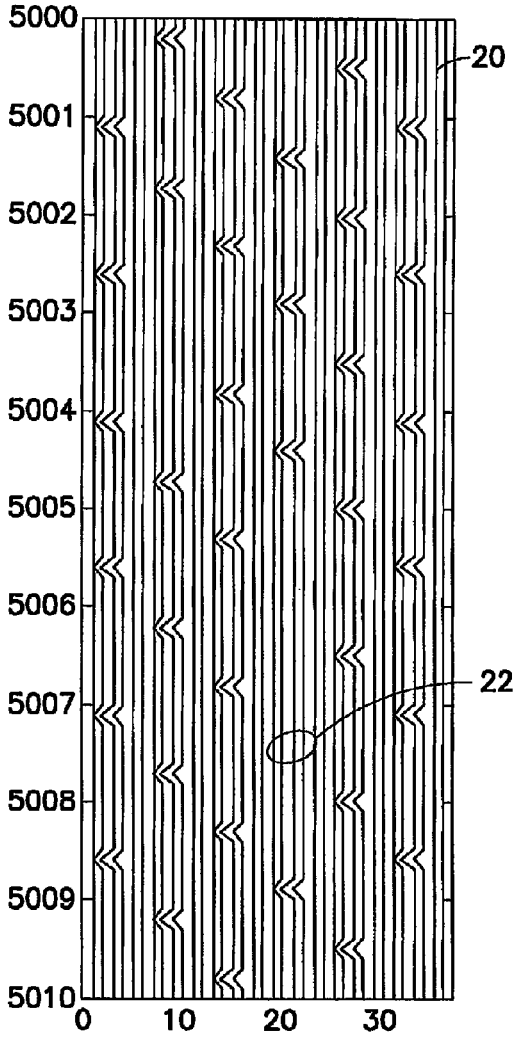
FIG. 2 provides an example data map resulting from an exemplary sensor array.

FIG. 2 provides an example data map resulting from an exemplary sensor array 10. The array 10 that provided the data has a single ring 14 (zero redundancy) of thirty-six (36) hot film sensors around the casing 12 and has been pulled from depth 5010 to 5000 in a flowing well with 60 degree phased perforations, at six (6) shots per length interval. Each trace 20 in FIG. 2 represents the time response of each sensor 16. The trace 20 remains constant except when the flow from a perforation cools the sensor 16. As indicated by the dashed circle 22 on FIG. 2, the traces 20 show a non-flowing perforation at depth 5007.5.

The embodiments discussed thus far of the network 18 on which the sensor array 10 is mounted represent an "open" framework. In other words, the open network 18 allows fluid flow to flow through so that the flow from the perforations is not impeded. However, in certain circumstances it might be advantageous to provide a "closed" network 18 that prevents fluid flow therethrough.

Figure 3:
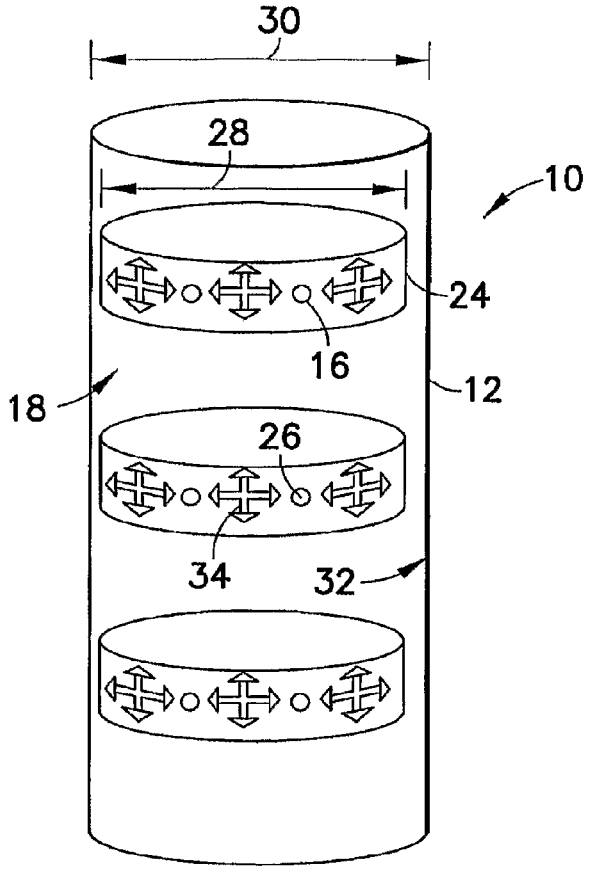
FIG. 3 illustrates an embodiment of the present invention in which the sensor array is mounted on a closed network.
Figure 4:
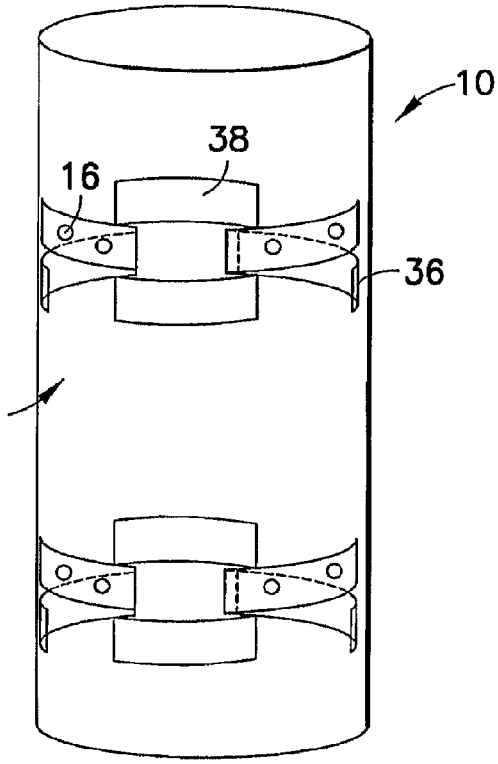
FIG. 4 illustrates another embodiment of the present invention in which the sensor array is mounted on a closed network.

FIGS. 3 and 4 provide illustrative examples of the present invention wherein the sensor array 10 is mounted on a closed network 18. In the embodiment shown in FIG. 3, the sensors 16 are mounted on the outside surface 26 of one or more cylindrical belts 24 and lowered downhole on a tool such as a centralized mandrel. The one or more belts 24 have an outer diameter 28 that is slightly smaller than the inner diameter 30 of the casing 12 and can be comprised of a thin metal, for example. When the one or more belts 24 pass a flowing perforation, the fluid cannot flow through the belts 24, but rather is diverted substantially parallel to the inner surface 32 of the casing 12 and the outer surface 26 of the one or more belts 24 (as indicated by the arrows 34).

The diversion of the fluid flow results in the flow spending more time near the sensors 16, resulting in more reliable data readings. Additionally, the diversion acts to isolate the perforation flow from the main flow in the wellbore that tends to mix up and obscure the flow from the individual perforations.

Another embodiment of the present invention in which the sensor array 10 is mounted on a closed network 18 is illustrated in FIG. 4. In this embodiment, the sensors 16 are placed on overlapping leaves 36 mounted on arms 38 that are lowered downhole on a tool such as a centralized mandrel. In this configuration, the overlapping leaves 36 enable the sensor array 10 to fold up easily to facilitate passage through the casing 12. Depending upon the nature and spacing of the sensors 16, there can be one set of overlapping leaves 36 or can be a plurality of overlapping leaves 36 mounted along the length of the tool.

Figure 5:
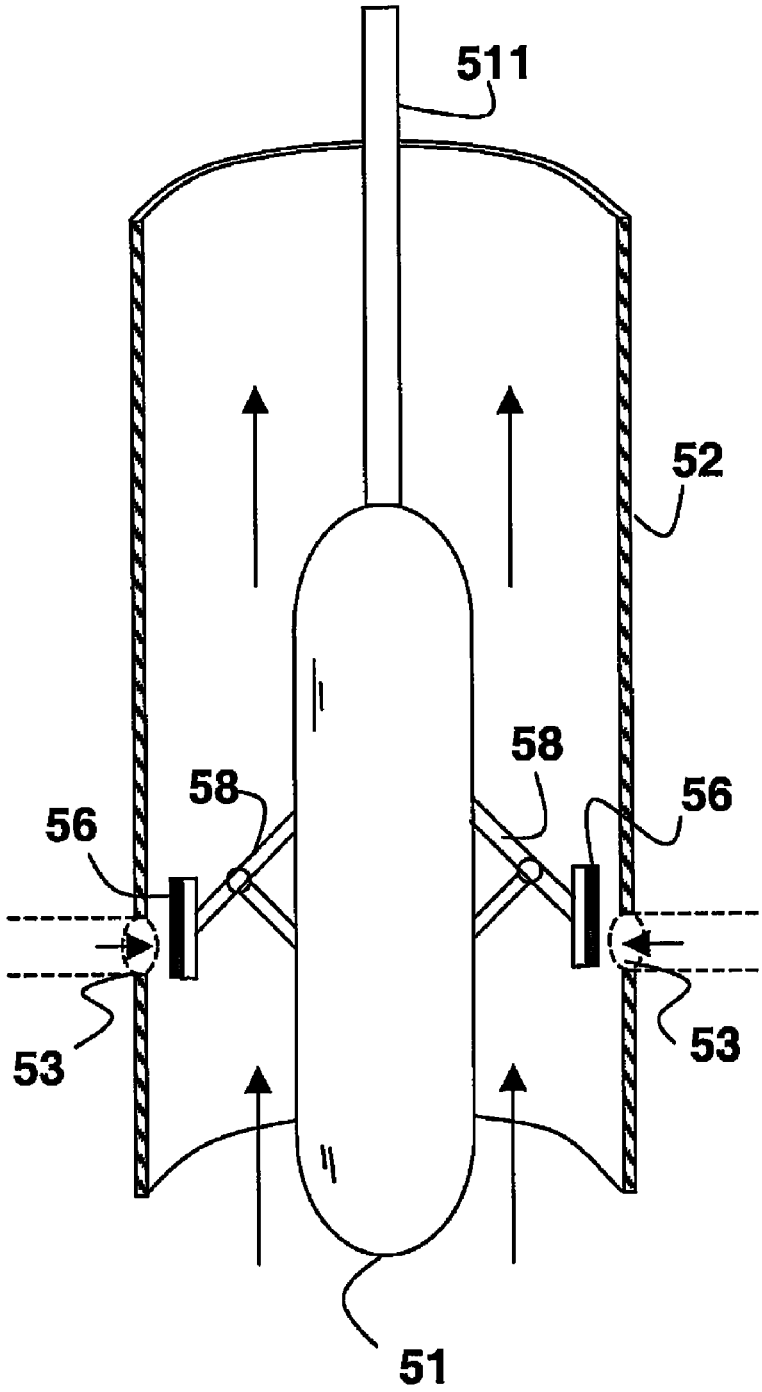
FIG. 5 illustrates another embodiment of the present invention in which sensors are mounted on a plurality of arms extending from a main tool body.

Another embodiment of the present invention is illustrated in FIG. 5. In this embodiment, the sensors 56 are placed on a plurality (only two shown) of arms 58 that extend in operation from the main body 51 of the tool. The main body 51 is moved in the wellbore on a conveyance tool 511, which can be a wireline, a coiled tubing, a drillstring or any other suitable conveyance apparatus. In this configuration, the extending arms 58 enable the sensors 56 to fold up easily to facilitate passage through the casing 52 and to be brought into close proximity to the opening 53 of perforations. The sensors 56 are shown oriented such that their sensitive face is oriented towards the flow from the perforations and less exposed to the main flow. Arrows indicate the respective flow directions.

In a variant not shown for the sake of clarity, the sensors 56 are placed in a protective cage such that the arms 58 can be extended in operation against the inner wall of the casing 52 without causing damage to the sensors.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An apparatus for detecting the behaviour of perforations in a wellbore casing, the wellbore casing having an interior surface defining an internal diameter, the apparatus comprising:

a sensor array movable within the internal diameter of the casing, the sensor array having one or more sensors located proximate the internal surface of the casing with the sensors being located or oriented such that properties of flow from a proximate perforation can be distinguished from properties of a main flow through the wellbore, wherein the sensor array is mounted on a flexible network able to conform to the internal diameter of the casing, and wherein the flexible network comprises at least one of a wire mesh and an expandable screen.

2. The apparatus of claim 1, wherein the one or more sensors are integrated on a single chip.

3. The apparatus of claim 1, wherein the one or more sensors are hot film flow sensors.

4. The apparatus of claim 1, wherein the one or more sensors are temperature sensors.

5. The apparatus of claim 1, wherein the one or more sensors are fluid conductivity sensors.

6. The apparatus of claim 1, wherein the one or more sensors are dielectric constant sensors.

7. The apparatus of claim 1, wherein the one or more sensors are selected from viscosity sensors, density sensors, chemical sensors, and piezoelectric sensors.

8. The apparatus of claim 1, wherein the one or more sensors are adapted to sense local properties.

9. The apparatus of claim 1, wherein the one or more sensors have a directional sensitivity and are oriented such as to sense flow as entering the wellbore from the perforation.

10. The apparatus of claim 1, wherein the sensor array comprises one or more sensor rings having one or more sensors located thereon.

11. The apparatus of claim 10, wherein the one or more sensor rings are rotated in relation to the adjacent sensor ring.

12. An apparatus for detecting the behaviour of perforations in a wellbore casing, the wellbore casing having an interior surface defining an internal diameter, the apparatus comprising:

a sensor array movable within the internal diameter of the casing, the sensor array having one or more sensors located proximate the internal surface of the casing with the sensors being located or oriented such that properties of flow from a proximate perforation can be distinguished from properties of a main flow through the wellbore, wherein the sensor array is mounted on a flexible network able to conform to the internal diameter of the casing, and wherein the sensor array comprises one or more sensor rings having one or more sensors located thereon and the one or more sensor rings are rotated in relation to the adjacent sensor ring.

* * * * *